United States Patent [19]

Cartner

[11] Patent Number: 4,612,715

[45] Date of Patent: Sep. 23, 1986

[54] DITCHING APPARATUS WITH IMPROVED DITCHING BLADE

[76] Inventor: Jack O. Cartner, 1005 N. 8th St., Cambridge, Ohio 43725

[21] Appl. No.: 600,507

[22] Filed: Apr. 16, 1984

Related U.S. Application Data

[63] Continuation of Ser. No. 416,642, Sep. 10, 1982, abandoned.

[51] Int. Cl.[4] ..... E02F 5/08

[52] U.S. Cl. ..... 37/92; 37/142 R; 37/189; 172/98; 172/108; 172/704; 403/4

[58] Field of Search ..... 37/91, 92, 189, 190, 37/141 T, 142 R, 142 A; 172/702, 703, 704, 735, 98, 108; 403/3, 4

[56] References Cited

U.S. PATENT DOCUMENTS

| | | | |
|---|---|---|---|
| 2,319,464 | 5/1943 | Massa | 37/91 X |
| 2,832,275 | 4/1958 | Kimsey et al. | 37/141 T |
| 3,453,756 | 7/1969 | Schroeder | 172/735 X |
| 3,648,391 | 3/1972 | Kabay et al. | 37/142 R X |
| 3,878,905 | 4/1975 | Schaumann | 37/142 R X |
| 4,069,604 | 1/1978 | Stepe | 37/141 T |

FOREIGN PATENT DOCUMENTS

| | | | |
|---|---|---|---|
| 487208 | 1/1976 | U.S.S.R. | 37/92 |

OTHER PUBLICATIONS

"Rotary Ditch Cleaner", Cartner Corp.
"Versa Ditcher", Terrain King Corp.
"Rotary Ditcher", Tiger Corp.

*Primary Examiner*—Edgar S. Burr
*Assistant Examiner*—Moshe I. Cohen
*Attorney, Agent, or Firm*—Fay, Sharpe, Fagan, Minnich & McKee

[57] ABSTRACT

The ditching apparatus includes a prime mover (A) and an arm assembly (B) for selectively positioning a ditching head (C). The ditching head includes a rotatably mounted circular supporting member (34) to which a plurality of mounting brackets (44) are mounted transversely and radially about an axis of rotation (36). A plurality of blades (50) are mounted to the brackets by a plurality of bolts (84). Each blade has first and second faces (66, 68) which are disposed symmetrically about a face axis (78). The faces terminate at first and second edges (52, 54) which are disposed symmetrically about an edge axis (56) and at first and second ends (60, 62) which are symmetric about an end axis (64). The blade includes a plurality of mounting apertures (80, 82) which are symmetrical with respect to both the end and edge axes. In this manner, the blade is reversible about both the end and edge axis to be mounted selectively in any one of four positions. This enables each of the four corners of the blade to be positioned to receive the heaviest wear, thus increasing blade life substantially fourfold.

15 Claims, 6 Drawing Figures

DITCHING APPARATUS WITH IMPROVED DITCHING BLADE

This is a continuation of application Ser. No. 416,642, filed Sept. 10, 1982, now abandoned.

BACKGROUND OF THE INVENTION

The present application pertains to the art of cutting and redefining ditches. The invention finds particular application in cleaning and maintaining roadside drainage ditches and will be described in reference thereto. However, the invention also finds application in other equipment for ditching, trenching, or otherwise cutting or moving soil.

Heretofore, ditching apparatus have included a tractor or other prime mover which provided propulsion along the roadway. An arm assembly extended from the tractor over any intermediate guardrails or the like to position a ditching head along the low point of a drainage ditch. The ditching head included a blade supporting member which was rotated transverse to the direction of travel. A plurality of blades were mounted on brackets extending from the leading face of the rotating support. The leading edge of the blades engaged the dirt and debris in the trench and impelled them tangentially outward. The leading edge of the blade, particularly the portion of the edge disposed toward the radially outward most end, received the brunt of the wear and abuse.

One of the problems with the prior art ditching apparatus is that frequent blade replacement was required. Complete blade replacement was commonly required when wear adjacent the outermost leading corner became excessive.

The present invention provides new and improved reversible ditching blades for ditching apparatus.

SUMMARY OF THE INVENTION

In accordance with the present invention, there is provided a new and improved ditching apparatus for removing dirt and debris to shape a ditch. The ditching apparatus includes a prime mover, an arm assembly operatively connected with the prime mover, and a ditching head operatively connected with the other end of the arm assembly. The ditching head includes a rotatably mounted support member, a motor means for rotating the support member, and a plurality of blade mounting brackets connected with the support member. A ditching blade is removably fastened with each of the mounting brackets. Each blade is symmetric about an axis extending between its leading and trailing edges such that the leading and trailing edges can be reversed.

In accordance with a more limited aspect of the invention, the ditching blade is further symmetric about an axis extending between its inner and outer ends such that the inner and outer ends can be reversed. This enables the blade to be selectively mounted in any one of four different positions and orientations greatly increasing the blade life.

In accordance with another aspect of the invention there is provided a ditching head which is adapted to be connected with the prime mover. The ditching head includes a support member, a motor means for rotating the support member, and a plurality of blade mounting brackets connected with a leading face of the rotary support member. Ditcher blades are connected with the mounting brackets. Each blade has first and second generally parallel surfaces which terminate at first and second ends and at first and second oppositely disposed edges. A plurality of apertures which extend between the first and second surfaces are adapted to align with like mounting apertures in the brackets. The blade apertures are disposed symmetrically about an axis extending centrally of the first and second edges. This enables the blade to be reversed when the leading edge becomes worn.

In accordance with yet another aspect of the invention, there is provided a ditching blade which is adapted to be reversibly mounted on a rotary ditching head. The ditching blade includes first and second surfaces which are disposed substantially parallel to each other. The first and second surfaces terminate at first and second edges which are symmetric about an axis extending centrally therebetween. The first and second surfaces converge adjacent the first and second edges. The first and second surfaces and the first and second edges terminate at oppositely disposed first and second ends. The first and second ends are symmetric about an axis extending centrally therebetween. The end axis and the edge axis are substantially perpendicular to each other. A plurality of mounting apertures which are symmetric with respect to both the end axis and the edge axis extend between the first and second surfaces. In this manner, the blade is reversible about both the end and edge axes to assume any one of four mounting positions.

A primary advantage of the present invention is that it extends blade life.

Another advantage of the present invention is that the ditching blades are reversible.

Yet another advantage of the present invention is that it is unnecessary to carry replacement blades in the field. Rather, worn blades can be rejuvinated without replacement parts by being reversed.

Still further advantages of the present invention will become apparent to others upon reading and understanding the following detailed description of the preferred embodiment.

BRIEF DESCRIPTION OF THE DRAWINGS

The invention may take form in various parts and arrangements of parts. The drawings are only for purposes of illustrating a preferred embodiment of the invention and are not to be construed as limiting it.

DETAILED DESCRIPTION OF THE PREFERRED EMBODIMENT

Figure 1:
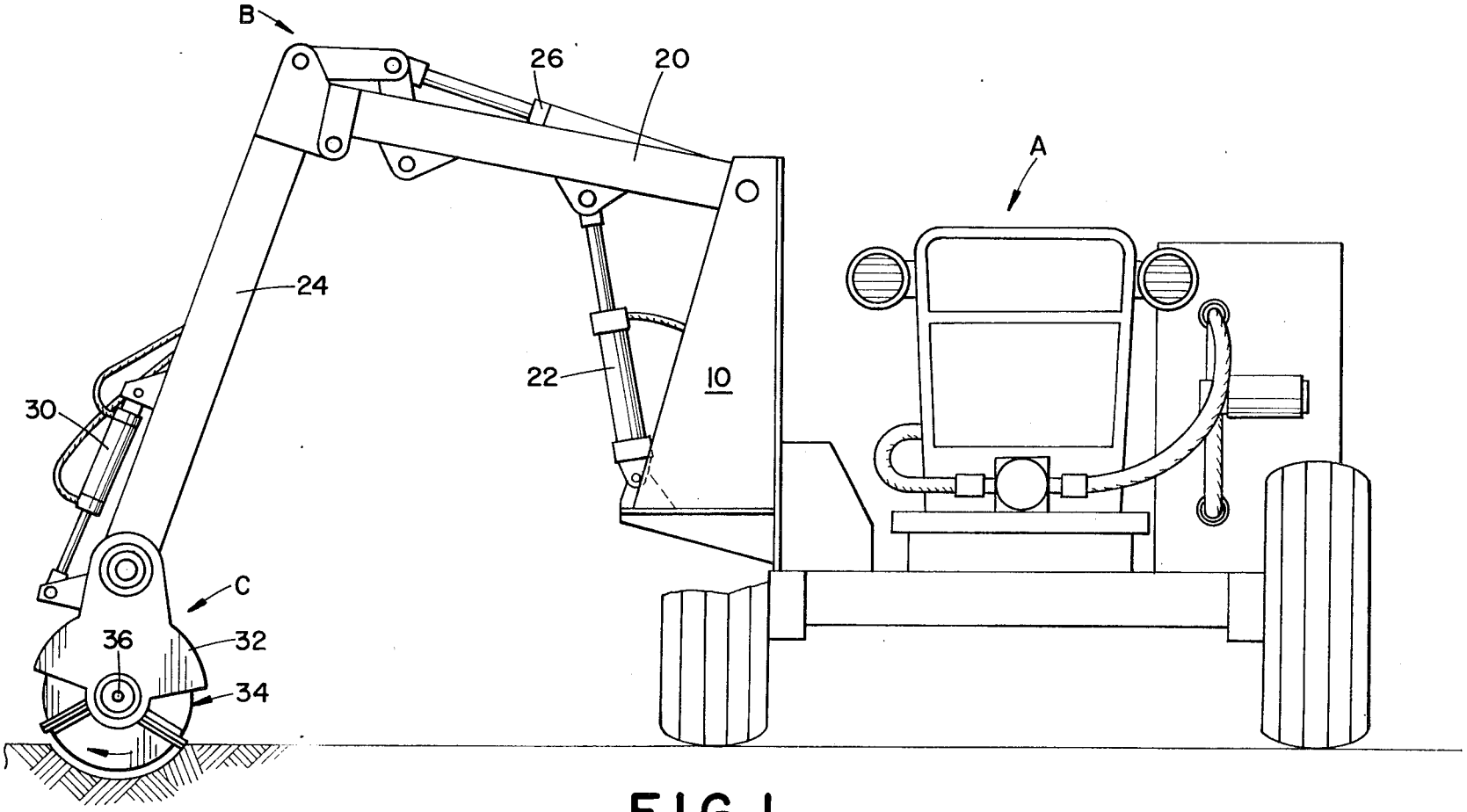
FIG. 1 is a plan view of a ditching apparatus in accordance with the present invention.

With reference to FIG. 1, the ditching apparatus includes a tractor A or other prime mover. An arm assembly B is connected at one end with the tractor and at its other end with a ditcher head C. The operator causes the arm assembly to position the ditcher head along the path to be ditched. The tractor is advanced causing the ditcher head to move along the ditch clearing the dirt and debris therefrom. During the ditching operation, the driver may cause the arm assembly to adjust the position of the ditcher head as may become appropriate to maintain the proper position and depth.

A post 10 is mounted on the frame of the tractor by a vertical pivot assembly such that it can rotate around a vertical axis. A breakaway control means (not shown) enables the post to pivot the arm assembly and ditcher head rearwardly in response to impacting a substantial, fixed object. The arm assembly includes a first arm 20 which is pivotally connected with the breakaway post and a first control means 22 for controlling its position relative to the prime mover. In the preferred embodiment, the first arm is pivotally connected with the post. However, it is contemplated that the first arm may also be slidably connected with the post. A second arm is operatively connected with the first arm and its position controlled by a second control means 26. In the preferred embodiment, the first and second arms are pivotally connected. However, it is contemplated that the first and second arms may be interconnected in a telescoping arrangement. Alternately, other arm assemblies such as a side arm assembly may be utilized.

The ditcher head C is pivotally connected with the far end of the second boom arm. A hydraulic cylinder or other control means 30 selectively controls the orientation of the ditcher head relative to the second arm. It is to be appreciated that as the relative positions of the first and second arms change, the orientation of the ditcher head relative to the earth may change correspondingly. The control means 30 adjusts the position of the ditcher head to maintain it in the proper orientation with respect to the ground. The ditcher head further includes a shield means 32 for shielding its moving parts and to protect the operator and others from flying debris. A support member 34 is rotatably mounted in the ditcher head for rotation about an axle 36. The rotating support member is partially received within the shield 32 and partially exposed for performing the ditching.

Figure 3:
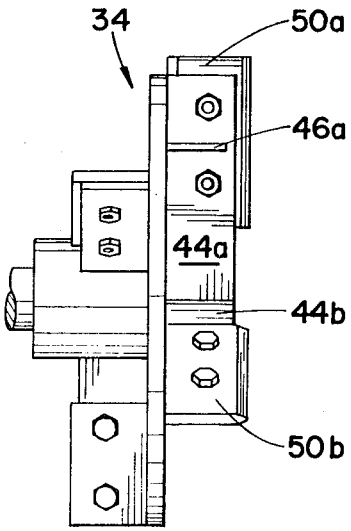
FIG. 3 is a side view of the rotary blade support member of FIG. 2.
Figure 4:
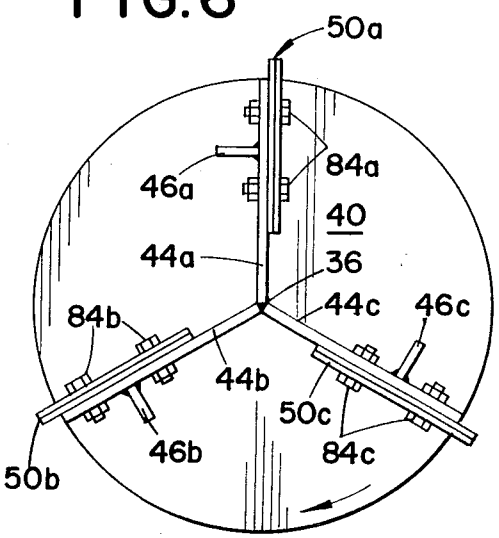
FIG. 4 is a plan view of the leading side of the rotary support member of FIG. 2.
Figure 2:
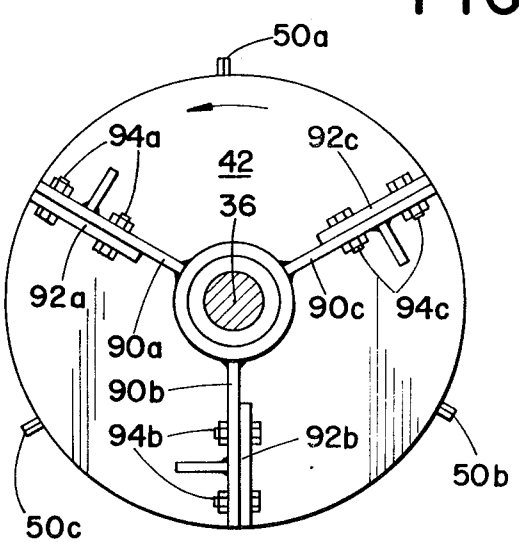
FIG. 2 is a rear view of a ditcher head rotating blade support member.

With particular reference to FIGS. 2, 3, and 4 and continuing reference to FIG. 1, the support member 34 has a leading face 40 and a trailing face 42. A plurality of support brackets 44*a*, 44*b*, and 44*c* are mounted perpendicular to the leading face and extend radially from the center of the rotational axis 36 to the periphery. A plurality of support members 46*a*, 46*b*, and 46*c* are disposed to the leeward side of the brackets during rotation. The support members and a welded connection of the support brackets at the central axis assist in the preventing the support brackets from being bent from perpendicular during ditching. A plurality of ditching blades 50*a*, 50*b*, and 50*c* are mounted on the support brackets 44*a*, 44*b*, and 44*c*, respectively.

Figure 6:
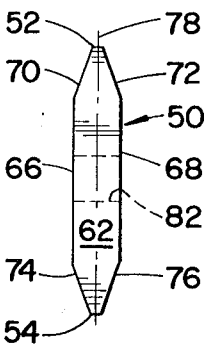
Figure 5:
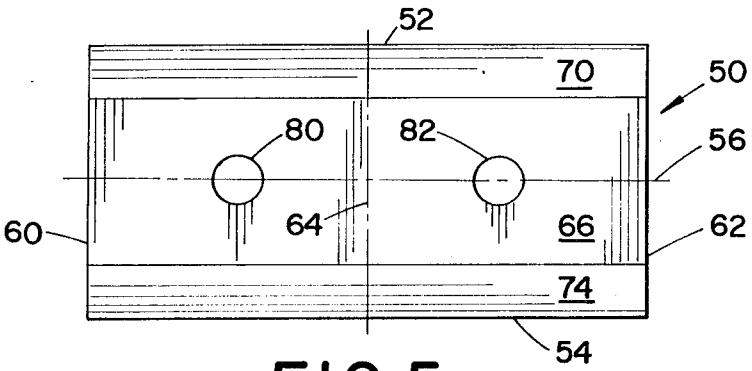
FIG. 5 is a plan view of a ditching blade in accordance with the present invention; and, FIG. 6 is an end view of the ditching blade of FIG. 2.

With particular reference to FIGS. 5 and 6, because each of the blades is the same, a typical or replacement blade 50 is described in FIGS. 5 and 6 and it is to be appreciated that the description applies to blades 50*a*, 50*b*, and 50*c*. Each blade is defined by a first edge 52 and an oppositely disposed second edge 54. The first and second edges are symmetric relative to an edge axis 56 which is disposed centrally therebetween. In the preferred embodiment, the first and second edges are linear and parallel. However, it is to be appreciated that the edges may jog or arc outward near their extremes to provide extra metal in the area of heaviest wear. The first and second edges extend between a first end 60 and an oppositely disposed second end 62. The first and second ends are disposed symmetrically about an end axis 64 disposed centrally therebetween. In the preferred embodiment, the first and second ends 60 and 62 are linear and parallel. Each blade has a first face 66 and a oppositely disposed second face 68. The first and second faces extend between the first and second ends and between the first and second edges. The first and second faces converge as they approach the first and second edges to form tapered face edge regions 70, 72, and 74, 76. In the preferred embodiment, the faces are rectangular and symmetric about a face axis 78 extending centrally therebetween.

A plurality of mounting apertures, in the preferred embodiment 80 and 82, extend between the first and second faces. The mounting apertures are disposed symmetrically with respect to the edge axis 56 and the end axis 64. The symmetry of the blade and the blade apertures about the perpendicular edge and end axes, enables the blade to be mounted in any one of four (4) positions. That is, the blade can be reversed or flipped about the edge axis and about the end axis. As will be appreciated, when the blades are mounted on the ditching head, the leading edge toward the radially outward end will receive the brunt of the wear. Further, the forward facing rotational surface and its tapered face edge region toward the leading edge will receive heavy wear. By reversing the blade about the end axis 64, the other end of the leading edge and the other face of the blade is positioned to receive the brunt of the wear. By reversing the blade about the edge axis, the leading and trailing edges and the blade faces are reversed, doubling or extending the life of the blade. By reversing the blade again about the end axis the fourth corner of the blade is positioned in the heaviest wear position. Thus, the blade is reversible about the end and edge axes to be mounted in any one of four different portions, in each of which positions a different edge/end junction or corner is in the location of greatest wear.

In the preferred embodiment, there are two mounting apertures positioned symmetric to the edge axis by being centered on it and symmetric to the end axis by being equidistant from it. Other symmetric aperture configurations are also contemplated. For example, a third aperture may be centered on the intersection of the end and edge axes. As yet another option four mounting apertures may be positioned a first common distance from the edge axis and a second common distance from the end axis. Still further symmetric aperture placements should be readily apparent to the reader.

With reference again to FIGS. 2, 3, and 4, a plurality of bolts or other fasteners removably attach the blades to the mounting brackets. Specifically, each mounting bracket has a plurality of apertures which align with some or all of the blade apertures. In the preferred embodiment, a pair of bolts 84*a*, 84*b*, and 84*c* pass through matching blade and bracket mounting apertures removably connect the blades with the brackets. Alternately, the bracket mounting apertures may align with only some of the blade mounting apertures or vice versa. For example, if the blade has four mounting apertures positioned as described above, the mounting bracket could have two mounting apertures which align with the blade mounting apertures closest to the trailing edge.

With particular reference to FIGS. 2 and 3, the blades loosen the dirt and debris and throw most of it from the ditch. However, some of the loosened material may remain after the blades have passed. To assist in removing the remaining loose material, a plurality of impellers are disposed on the rearward face 42 of the supporting member 34. The impellers each include a radially disposed impeller mounting bracket 90*a*, 90*b*, and 90*c* which each have a plurality of mounting apertures therein. A plurality of impeller paddles 92*a*, 92*b*, and 92*c* are bolted with the impeller mounting brackets by a plurality of pairs of bolts 94*a*, 94*b*, and 94*c* or other removable mounting means which extend through matching paddle and bracket apertures. The impeller paddles have leading and trailing edges disposed symmetrically about a central edge axis and inner and outer ends disposed symmetrically about a central end axis. The paddle apertures are disposed symmetrically about the paddle edge and end axes such that the paddles can be reversibly mounted in any of four positions.

The invention has been described with reference to the preferred embodiment. Obviously, modifications and alterations will occur to others upon reading and understanding the preceding detailed description of the preferred embodiment. It is intended that the invention be construed as including all such alterations and modifications insofar as they come with the scope appended claims or the equivalents thereof.

Having thus described a preferred embodiment, the invention is now claimed to be:

1. A ditching apparatus for removing dirt and debris to shape a ditch, the ditching apparatus comprising:

(A) a prime mover;

(B) an articulated arm assembly operatively connected at a first end with the prime mover for selectively positioning a second end thereof relative to the prime mover;

(C) a ditcher head operatively connected with the articulated arm assembly second end, the ditcher head including:

(i) a support member having a leading face and a trailing face and being mounted for rotation about a central axis transverse thereto, (ii) a motor means operatively connected with the support member for rotating the support member about the central axis, (iii) a plurality of ditching blade mounting brackets operatively connected with the support member leading face, each blade mounting bracket extending generally radially from the central axis and extending perpendicular to the support member leading face, (iv) a plurality of paddle mounting brackets disposed generally radially on the support member trailing face and extending rearwardly therefrom;

(D) a plurality of reversible ditching blades which are selectively and reversibly mountable to the mounting brackets, each blade having a major dimension which is mounted radially along each of the blade mounting brackets and a minor dimension which is mounted perpendicular to and extending forward from the support member leading face;

(E) a blade mounting means for selectively mounting each blade to one of the blade mounting brackets such that each blade extends radially outward beyond the support member and the blade mounting bracket and such that each blade extends forward from the support member leading face beyond the blade mounting bracket; and, (F) a plurality of paddles, each paddle being operatively connected with one of the paddle mounting brackets, whereby the paddles assist in removing dirt which has been cut and loosened by the ditching blades.

2. The ditching apparatus as set forth in claim 1 wherein each ditching blade includes:

first and second faces disposed parallel to each other and adapted to be mounted against one of the blade mounting brackets;

the first and second faces terminating at first and second edges which are symmetric about an edge axis extending parallel to the major dimension centrally between the first and second edges;

the first and second faces and the first and second edges terminating at oppositely disposed first and second ends which are symmetric to an end axis extending parallel to the minor dimension and centrally between the first and second ends.

3. The ditching apparatus as set forth in claim 2 wherein the blade mounting means includes a plurality of blade mounting apertures which extend between the first and second blade faces, the blade mounting apertures being symmetric with respect to both the end axis and the edge axis, such that the blade is reversible about the end and edge axes and wherein the blade mounting means further includes a plurality of blade mounting bracket apertures which align with the blade mounting apertures in each reversible mounting positions of the blades.

4. The ditching apparatus as set forth in claim 3 wherein the blade mounting apertures are each centered on the edge axis.

5. The ditching apparatus as set forth in claim 2 wherein the first and second faces converge adjacent the first and second edges.

6. The ditching apparatus as set forth in claim 5 wherein the blade first and second edges are symmetric about the blade end axis.

7. The ditching apparatus as set forth in claim 6 wherein the first and second blade ends are symmetric about the blade edge axis.

8. The ditching apparatus as set forth in claim 2 wherein the blade first and second edges extend substantially linearly between the first and second ends.

9. The ditching apparatus as set forth in claim 8 wherein the blade first and second ends extend substantially linearly between the first and second edges.

10. The ditching apparatus as set forth in claim 1 wherein each blade defines four cutting areas:

a first cutting area disposed on the first face and along a portion of the first edge adjacent the first end;

a second cutting area disposed on the second face and along a portion of the first edge adjacent the second end;

a third cutting area disposed on the first face and along a portion of the second edge adjacent the second end; and, a fourth cutting area disposed on the second face and along a portion of the second edge adjacent the first end, whereby each of the four cutting areas is selectively positionable in the radially outermost corner furtherest displaced from the support member leading face, at which corner the greatest amount of wear occurs.

11. A ditching head which is adapted to be connected by an arm assembly to a prime mover, the ditching head comprising:

(A) a support member having a leading face and a trailing face;

(B) means for rotating the support member about an axis of rotation which is substantially transverse to the leading face;

(C) a plurality of blade mounting brackets connected with the support member leading face and disposed substantially perpendicular thereto, each bracket extending generally radially from the axis of rotation and defining a plurality of radially spaced blade mounting bracket apertures which are adapted to receive fastening means therethrough;

(D) a plurality of four-way reversible ditching blades which are selectively positionable with any one of four corners disposed away from the support member and radially outward from the axis of rotation for quadrupling blade life, each blade including:

(1) a first face;

(2) a second face disposed symmetric to the first face about a face axis extending centrally therebetween;

(3) the first and second faces terminating at a first edge and a second edge, the first and second edges being symmetric about an edge axis extending centrally therebetween;

(4) the first and second faces converging adjacent the first and second edges;

(5) the first and second faces and the first and second edges terminating at oppositely disposed first and second ends, the first and second ends being symmetric about an end axis extending centrally therebetween and being symmetric about the edge axis, the end axis and the edge axis being substantially perpendicular to each other;

(6) the first and second edges further being symmetric about the end axis;

(7) a plurality of blade apertures extending through the edge axis between the first and second faces, the blade apertures being positioned symmetric with respect to both the end axis and the edge axis, the blade mounting apertures being aligned with the bracket mounting apertures in each of four blade mounting positions, whereby the blade is four-way reversible;

(8) the first and second edges being longer than the first and second ends such that the blade extends a greater distance radially than outward from the support member leading face;

(E) a plurality of fastening means extending through the aligned bracket and blade mounting apertures for removably mounting the blades to the brackets; and, (F) a plurality of paddle mounting brackets disposed generally radially on the support member trailing face and extending rearwardly therefrom and a plurality of paddles, each paddle being operatively connected with one of the paddle mounting brackets, whereby the paddles assist in removing dirt which has been cut and loosened by the ditching blades.

12. The ditching head as set forth in claim 11 wherein the first and second edges extend substantially linearly between the first and second ends.

13. The ditching head as set forth in claim 12 wherein the first and second ends extend substantially linearly between the first and second edges.

14. The ditching head as set forth in claim 11 wherein there are two mounting apertures which are disposed centrally on the edge axis and equidistant to either side of the end axis.

15. In a ditching apparatus for removing dirt and debris to shape a ditch, which ditching apparatus comprises a prime mover, an arm assembly operatively connected at a first end with the prime mover, a ditcher head operatively connected with a second end of the arm assembly, the ditcher head including a rotatably mounted support member, a motor means for rotating the support member, a plurality of paddle mounting brackets disposed generally radially on a trailing face of the support member and extending rearwardly therefrom, a plurality of paddles, each paddle being operatively connected with one of the paddle mounting brackets, a plurality of blade mounting brackets connected with a leading face of the rotary support member, the blade mounting brackets include a plurality of mounting apertures extending therethrough, a plurality of ditching blades removably fastened to the blade mounting brackets, each blade being a generally planar rectangle which is symmetric about each of three axes to be four-way reversible for fastening to the blade mounting brackets in any one of four orientations to quadruple blade life, each ditching blade including:

(a) a first and second generally planar faces disposed symmetrically relative to a face plane extending centrally therebetween;

(b) the first and second faces terminating at oppositely disposed first and second ends, the first and second ends being symmetric about an end axis which extends centrally therebetween;

(c) the first and second faces further terminating at oppositely disposed first and second edges being symmetric about an edge axis extending centrally therebetween and perpendicular to the end axis;

(d) the first and second edges, faces, and ends defining four cutting areas;

(i) a first cutting area disposed along contiguous portions of the first edge, the first face, and first end;

(ii) a second cutting area disposed along contiguous portions of the first edge, the second face, and second end;

(iii) a third cutting area disposed along contiguous portions of the second edge, the first face, and second end; and, (iv) a fourth cutting area disposed along contiguous portions of the second edge, the second face, and first end;

(e) a plurality of mounting apertures extending between the first and second faces and disposed symmetric with respect to both the end and edge axes, the blade and bracket mounting apertures being disposed relative to each other such that the blade is mountable:

(i) with the second edge along the rotatably mounted support member and the first end extending generally radially beyond the rotary support member such that the first cutting area is disposed radially and axially outermost;

(ii) with the second edge disposed along the rotatably mounted support member and the second end extending radially beyond the radial support member such that the second cutting area is disposed radially and axially outermost;

(iii) with the first edge along the rotatably mounted support member and the second end extending generally radially beyond the radial support member such that the third cutting area is disposed radially and axially outermost; and, (iv) with the first edge disposed along the rotatably mounted support member and the first end extending radially beyond the radial support member such that the fourth cutting area is disposed radially and axially outermost;

whereby each blade is selectively mountable in four positions to quadruple blade life.

* * * * *